US010191451B2

(12) United States Patent
Rhul et al.

(10) Patent No.: US 10,191,451 B2
(45) Date of Patent: Jan. 29, 2019

(54) SYSTEM AND METHOD FOR MANUFACTURING A LIGHT GUIDE HAIRSPRING FOR A TIMEPIECE MOVEMENT

(71) Applicants: Philippe Rhul, Paris (FR); Sylvain Allano, Montlhéry (FR)

(72) Inventors: Philippe Rhul, Paris (FR); Sylvain Allano, Montlhéry (FR)

( * ) Notice: Subject to any disclaimer, the term of this patent is extended or adjusted under 35 U.S.C. 154(b) by 889 days.

(21) Appl. No.: 14/411,299

(22) PCT Filed: Jun. 24, 2013

(86) PCT No.: PCT/FR2013/000161

§ 371 (c)(1),
(2) Date: Jun. 29, 2015

(87) PCT Pub. No.: WO2014/001660

PCT Pub. Date: Jan. 3, 2014

(65) Prior Publication Data

US 2015/0309476 A1 Oct. 29, 2015

(30) Foreign Application Priority Data

Jun. 28, 2012 (FR) ..... 12 01831

(51) Int. Cl.
*G04B 17/06* (2006.01)
*G04D 7/00* (2006.01)
(Continued)

(52) U.S. Cl.
CPC ..... *G04B 17/066* (2013.01); *G04B 17/227* (2013.01); *G04D 3/0041* (2013.01);
(Continued)

(58) Field of Classification Search
CPC .. G04B 17/066; G04B 17/227; G04D 3/0041; G04D 7/004; Y10T 29/49579; Y10T 29/49581; Y10T 29/49609
See application file for complete search history.

(56) References Cited

U.S. PATENT DOCUMENTS 7,726,872 B2 * 6/2010 Levingston ..... B21F 35/04 368/175

FOREIGN PATENT DOCUMENTS

FR 2957688 A1 * 9/2011 ..... G04B 17/063

OTHER PUBLICATIONS

English Machine Translation of FR2957688A1, Philippe Rhul and Sylvain Allano, Published Sep. 23, 2011.*

* cited by examiner

*Primary Examiner* — Sarang Afzali

(57) ABSTRACT

A method to manufacture a hairspring of a timepiece movement, which includes: producing a malleable elongated element in a form of under a fiber or ribbon form, from a first heated material capable of guiding light; conforming the malleable elongated element in order to achieve into a spiral form; and handling processing the spiral form thus created in order to obtain a hairspring for providing both a mechanical oscillating function in a balance wheel and a light guiding guide lighting function arranged for in situ adjusting of a mechanical performance of said hairspring. The conforming includes coiling the malleable elongated element around a rotating mobile conformation tool, and receiving the malleable elongated element in a guiding channel within a guiding mechanism and guiding the received malleable elongated element via mobile equipment turning on an inner periphery of the guiding mechanism.

4 Claims, 3 Drawing Sheets

(51) Int. Cl.
*G04B 17/22* (2006.01)
*G04D 3/00* (2006.01)

(52) U.S. Cl.
CPC ..... *G04D 7/004* (2013.01); *Y10T 29/49581* (2015.01); *Y10T 29/49609* (2015.01)

Fig.01
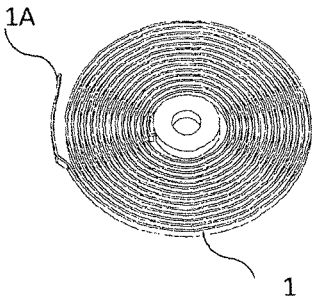
Fig.02
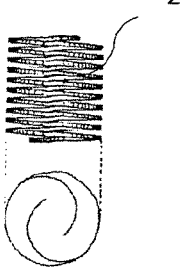
Fig.03
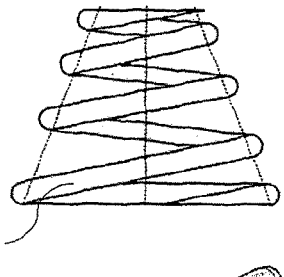
Fig.04
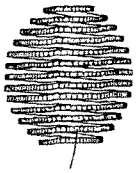
Fig.05
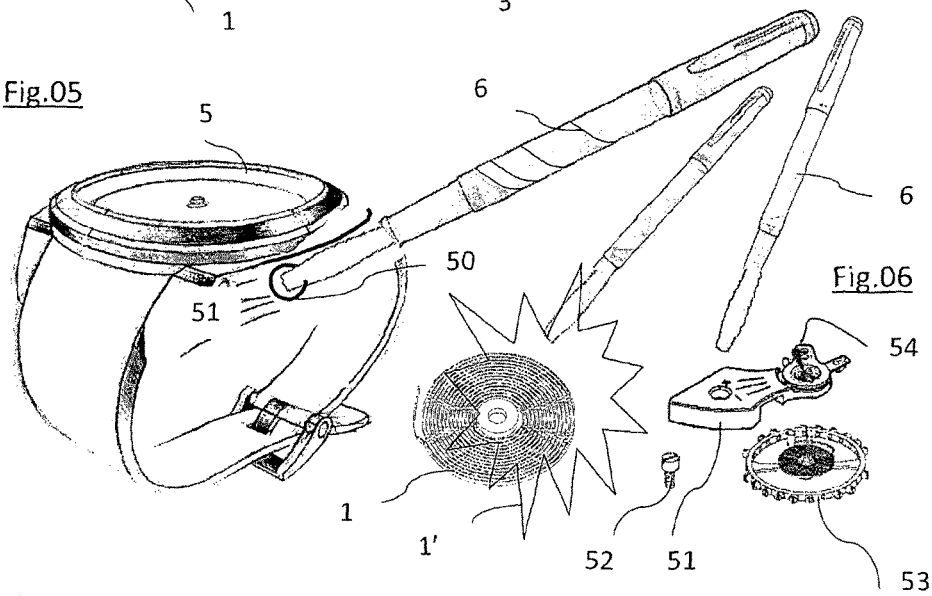
Fig.06
Fig.07
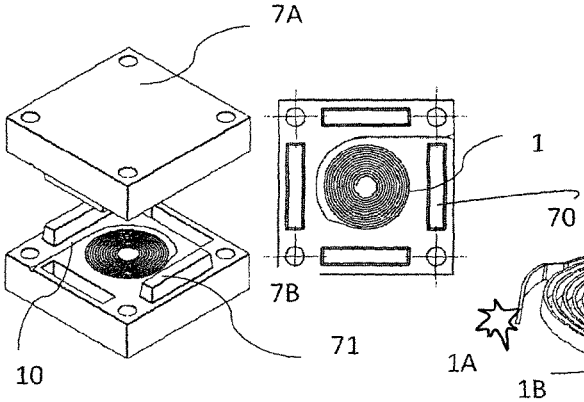
Fig.06A
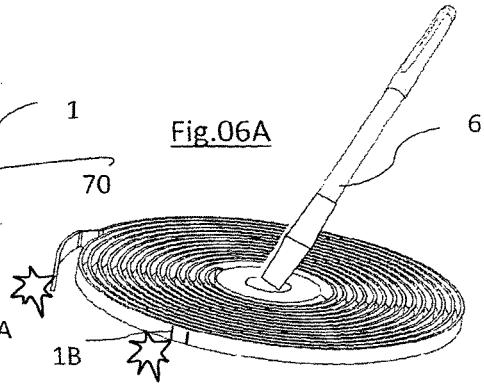

Fig.12
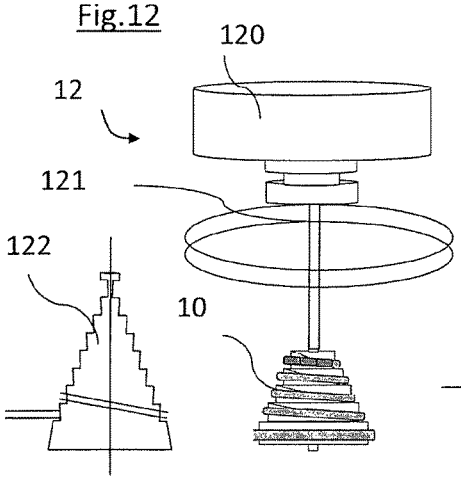
Fig.13
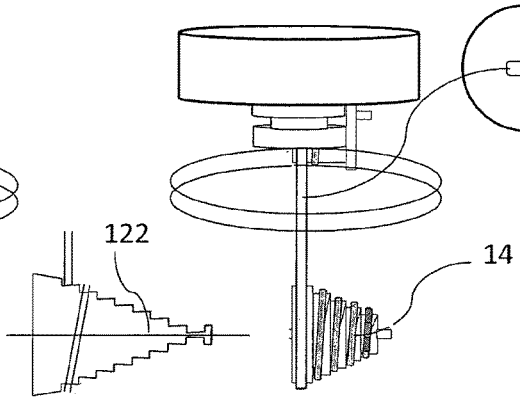
Fig.14
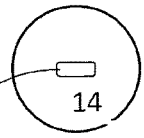
Fig.15
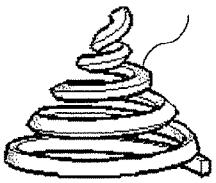
Fig.16
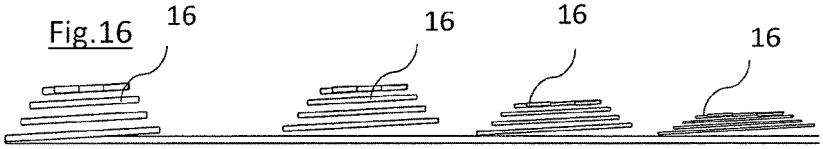
Fig.17
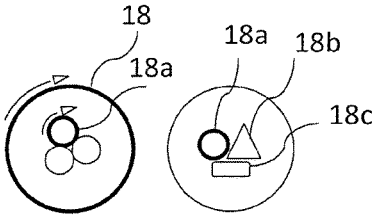
Fig.18
Fig.19
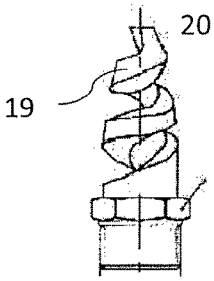
Fig.20
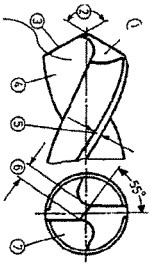
Fig.21
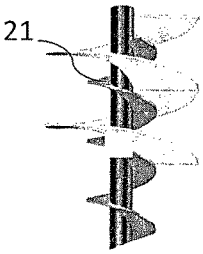
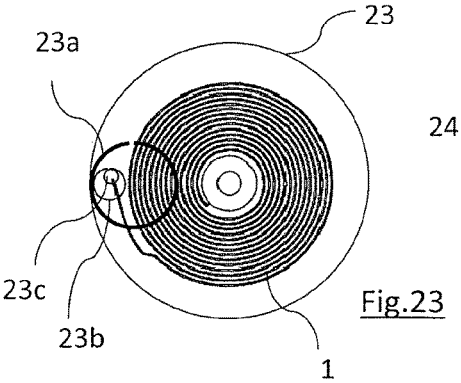
Fig.23
Fig.24
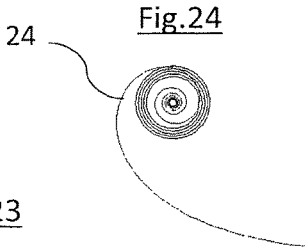
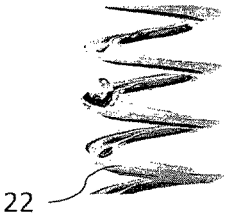
Fig.22

SYSTEM AND METHOD FOR MANUFACTURING A LIGHT GUIDE HAIRSPRING FOR A TIMEPIECE MOVEMENT

Light guide hairspring, in situ control system of a timepiece movement equipped with the aforesaid hairspring, and portable control device

CROSS-REFERENCE TO RELATED APPLICATIONS

This application is a National Phase Entry of International Patent Application No. PCT/FR2013/000161 filed on Jun. 24, 2013 by Philippe Rhul et al., claiming the benefit of French Patent Application No. 1201831 filed on Jun. 28, 2012. The aforementioned applications are hereby incorporated by reference herein.

FIELD OF THE INVENTION

The present invention concerns a hairspring for a timepiece movement, designed to provide, aside from its initial mechanical oscillating function, a light-guiding function. It also concerns an in situ control system of a timepiece movement equipped with the aforesaid hairspring, as well as a portable control device implemented in this system.

BACKGROUND OF THE INVENTION

Previous attempts to produce a hairspring in a different material than metal alloy-based materials traditionally used in the watchmaking industry can be found in prior art. One may mention the case of hairsprings produced in glass, for example Cartier's hairspring in Zerodur used in its ID-one timepiece, or also the Spiromax of Patek. The point was to reduce the hairspring's sensitivity to temperature variations in order to achieve a perfect isochronism.

Furthermore, watchmakers aspire to have more efficient tools at their disposal to control and adjust the balance wheel than those currently available.

BRIEF SUMMARY OF THE INVENTION

The first objective of the present invention is to offer a new hairspring concept that allows control of its mechanical performances and in situ adjustment.

Another objective of the invention is to offer an in situ control and metrology system for timepiece movements equipped with dual mechanical-optical function hairsprings.

This objective is achieved with a timepiece movement hairspring, produced from a material capable of guiding light, characterized in that it is adapted to provide an in situ control of mechanical performances, notably of isochronism, of the aforesaid timepiece movement, from an injection of an optical beam in the aforesaid hairspring.

This hairspring is advantageously designed to cooperate with control equipment external to the timepiece movement. It may feature optical index gradient zones which are sensitive to mechanical deformation, and/or, on at least part of its outer surface, a coating providing an adjustment of its mechanical performances.

In a particular form of implementation of the invention, this hairspring possesses a composite structure combining a first hairspring in a first translucent material and a second hairspring in a second material possessing different mechanical characteristics from those of the aforesaid first material, the first and second hairsprings being closely bound to one another.

A further aspect of the invention, an in situ control system of a hairspring according to the invention is proposed, this hairspring being in action within a timepiece movement and produced from an optical fiber or ribbon, this system comprising (i) measuring systems possessing the means to inject in the aforesaid fiber or optical ribbon an incident light beam of control, (ii) means to receive in return a reflected light beam of control, means to process the aforesaid beams, respectively incident and reflected, in order to produce information of measured mechanical performances, notably isochronism, of the aforesaid hairspring.

Another further aspect of the invention, a control device integrating in an enclosure the measuring means of a control system according to this invention is proposed.

When this device is implemented for the metrological control of a timepiece whose movement is equipped with an optical hairspring according to the invention and possessing the means to join optically the aforesaid hairspring to a porthole fulfilling the function of optical port positioned on the surface of the aforesaid timepiece case, it is then designed to enable an optical coupling of its optical interface with the aforesaid optical port.

When this device is implemented to control and adjust a timepiece movement equipped with an optical hairspring according to the invention, the aforesaid optical hairspring features a fixed external optical end and a mobile internal optical end joined to an axis of a balance wheel, it is then designed to enable an optical coupling of its optical interface with the aforesaid internal optical end.

This control device may be advantageously designed to be portable under the form of a handheld tool.

BRIEF DESCRIPTION OF THE SEVERAL VIEWS OF THE DRAWINGS

A greater understanding of the present invention will be obtained through a detailed description of various production methods in reference to the following Figures:

FIGS. 1 to 4 illustrate various hairspring forms producible according to the invention, respectively flat (Archimedean hairspring), cylindrical, conical, and near-spherical;

FIG. 5 illustrates the implementation of an in situ control system according to the invention;

FIG. 6 represents an exploded view of the timepiece movement components involved in the use of an in situ control system according to the invention;

FIG. 6A illustrates a particular implementation of an in situ control system according to the invention;

FIG. 7 illustrates an example of an optical guiding hairspring produced according to the invention, implementing a casting process;

FIG. 12 represents schematically a first example of the manufacturing method according to the invention, implementing a fiber drawing tower and a fusee;

FIG. 13 represents schematically a second example of the manufacturing method according to the invention, with a fiber drawing tower and a fusee;

FIG. 14 illustrates a rectangular preform used in the manufacturing method illustrated in FIG. 13;

FIG. 15 illustrates schematically a spiral form as obtained with one of the manufacturing methods implementing a fusee;

FIG. 16 illustrates schematically a flattening process of this spiral form;

FIG. 17 represents a particular implementation phase of the shaping of the optical guiding hairspring thus obtained;

FIG. 18 illustrates preform examples for the optical fibers consisting of a spiral according to the invention;

FIGS. 19 to 22 illustrate tooling examples that may be implemented for the production of conformed fibers intended to become a hairspring according to the invention;

FIG. 23 illustrates schematically another example of the manufacturing method according to the invention, implementing a preform of eccentric trajectory; and FIG. 24 represents the preform trajectory implemented in the method of FIG. 23.

DETAILED DESCRIPTION OF THE INVENTION

Figure 8:
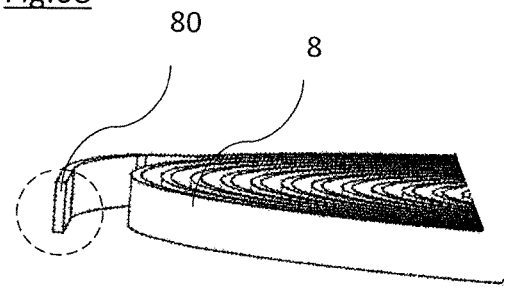
FIG. 8 illustrates an optical guiding hairspring according to the invention featuring a rectangular section.

We will now describe, in reference to the aforementioned Figures, production examples of the optical guiding hairsprings manufacturing methods according to the invention. In reference to FIGS. 1 to 1, by implementing the manufacturing method according to the invention, several hairsprings of different shapes may be produced. Therefore, in reference to FIG. 1, the method according to the invention may allow the production of an Archimedean hairspring 1 from a ribbon 1A created with a material possessing the appropriate mechanical properties for a mechanical oscillator and the optical properties providing a light-guiding function. It is also possible to produce a hairspring 2 of helical or cylindrical shape, in reference to FIG. 3. This hairspring may also be of conical shape (3, FIG. 3) or near-spherical with several blades extending from the ferrule (4, FIG. 4).

In reference to FIG. 6, the optical function hairspring 1 may be integrated into a timepiece movement 5 equipped with a porthole 50 situated on the outer edge 51 of its case and made with a transparent material to which an optical fiber is internally fastened and connected to the outer end of the hairspring 1. A device 6, such as a handheld portable device, possessing the shape of a pen for example, is provided (i) to inject from its end a light beam into the hairspring 1 through the porthole 50 and the internal optical fiber within the movement and (ii) to receive a light beam reflected back by the hairspring 1. If the timepiece 5 is of "skeletal" type or is configured into a form that allows the hairspring 1 to be visible from the exterior of the timepiece, an action command on the device 6 has for effect to produce a light effect 1' induced by the light diffusing from the hairspring 1.

The optical fiber implemented in the timepiece 5 may be a nanofiber, of 30 to 5 nm diameter for example, which may be produced with one of the methods currently available in the optical fiber industry or in research centers equipped with fiber drawing towers intended for the production of nanofibers. PCVD, MCVD, DRIE, or anisotropic chemical micromachining methods may be considered for the production of these fibers.

The device 6 may also be configured in order to enable, on a timepiece movement directly accessible—for example extracted from the timepiece case or on a manufacturing line or in maintenance—, an in situ control of the hairspring's 1 dynamic performances and the adjustment of the balance wheel 53 by action on an adjusting screw 52 at the index-assembly 51 level supporting the ferrule 54 of the balance wheel 53, as illustrated by FIGS. 6 and 6A.

The active end of the device 6 is then positioned at the ferrule level so that the light beam emitted by the device 6 is injected, through an optical guide (not shown) installed on the shaft of the balance wheel 53, into the inner end of the hairspring 1 fixed to the shaft. The light is then guided inside the hairspring 1 ribbon and illuminates the optically active zone 1B and the outer end 1A of the hairspring 1. If the hairspring 1 ribbon has been processed to limit light diffusion through its side walls, the optically active zones 1B may then be non-processed zones, and therefore diffusing.

The optical function of the hairspring 1 associated to the device 6 allows the use of stroboscopic or interference techniques in order to control the balance wheel's 53 frequency and potential frequency drifts. The device 6 may, for example, feature on its surface ridges or rings fulfilling the function of light frequency control indicators. These ridges or rings fulfill therefore a light scaling function enabling optical adjustment of isochronism.

Also, during its manufacturing, the hairspring 1 may be provided with control zones with distinct optical characteristics than those of the spiral ribbon's main body, and these control zones may be selectively activated according to the effective oscillating frequency, thus providing indications of frequency drifts. The device 6 may have an end featuring a dual optical transmitter/receiver function and a precision screwdriver to adjust the index-assembly.

It should be noted that the present invention may benefit from the most advanced studies in the field of optical fibers integrating electronics, in reference for example to the article "*La fibre optique devient électronique*" [The Optical Fiber Becomes Electronic] by Jean-Pierre Vernay, published on May 4, 2006 in the magazine "L'Usine Nouvelle" no. 3008.

In particular, the use of a microstructured fiber may be considered. The structure of such a fiber is composed of a glass core surrounded by hollow capillaries. The semiconductor elements made of silicon or germanium, and capable of achieving the desired electronic functions, have already been embedded in such microstructured fibers.

The light beam produced by the device 6 may be emitted by a laser diode or a light-emitting diode whose optical characteristics have been chosen according to the desired type of measurement to be implemented.

We will now describe several examples of the practical implementation of the manufacturing method according to the invention. In reference to FIG. 7, a two-part mold 7A, 7B featuring corresponding studs 71 and hollow parts 70, intended for the "wafer" type process, is provided. The lower part of the mold 7B features a groove of spiral form intended to receive a malleable element previously produced under a ribbon or fiber form 10.

This mold is intended to be placed in a furnace or to be itself equipped with integrated heating means. Therefore, it is possible to conform the ribbon or fiber by subjecting it to appropriate pressure and temperature conditions in order to obtain a conformed hairspring 1 with dual mechanical-optical function.

Figure 9:
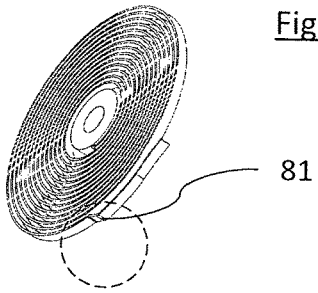
FIG. 9 represents the hairspring of FIG. 8 whose outer end was subjected to a subsequent bending operation.

In reference to FIG. 8, the manufacturing method according to this invention is designed for the production of hairsprings with an optical fiber 8 of rectangular section 80 that may have been obtained with conventional fiberization techniques, but by preforming it with a rectangular die in the fiber drawing tower. It is possible to obtain a suitable bending 81 of the hairspring's outer end by using a mold shown in FIG. 7 and in reference to FIG. 9.

Figure 10:
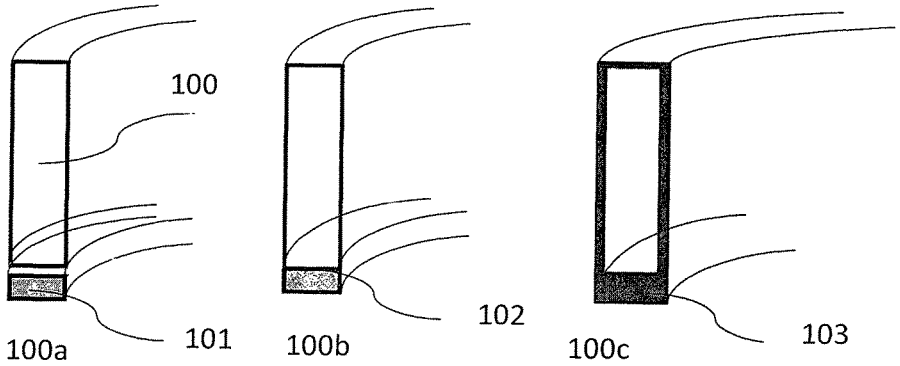
FIG. 10 represents schematically the production steps of a hairspring according to the invention featuring a DLC coating.

The manufacturing method according to the invention may incorporate material combinations in order to achieve the expected mechanical performances of a hairspring for a timepiece movement. Therefore, in reference to FIG. 10, the conformation phase may include an affixing sequence 100*a* of an optical fiber 100 of rectangular section—raised to a temperature that renders it malleable—on a hairspring sole 101 made in a DLC-type material ("Diamond-Like Carbon"). The optical fiber 100 is then sealed (100*b*) on the DLC sole using a suitable adhesive 102 or by thermal bonding. It can also be provided (100*c*), that the whole fiber 100 benefits from a DLC coating 103 of 10 nm thickness, in order to achieve the required mechanical performances while controlling light diffusion on the fiber's side walls.

Figure 11:
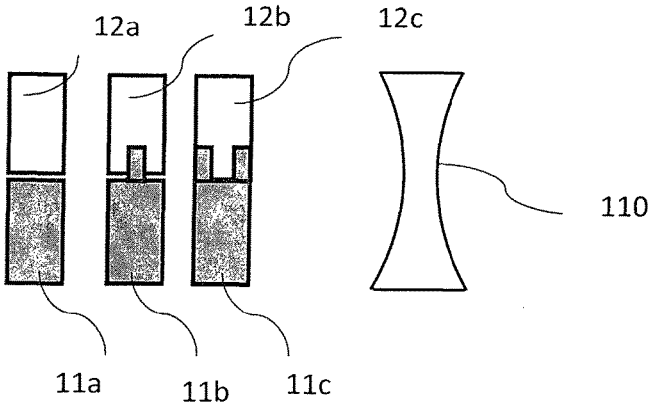
FIG. 11 illustrates different hairspring configurations according to the invention.

The manufacturing of a "hybrid" hairspring, combining an optical dominant function material and a mechanical dominant function material, falls within the scope of the field of application of the manufacturing process according to the invention. Therefore, in reference to FIG. 11, the spiral ribbons that were previously made with either one of these "optical" or "mechanical" materials may be assembled in various configurations during the conformation stage. As non-limiting examples, one may superpose an "optical" ribbon 12*a* to a "mechanical" ribbon 11*a*, or create a casing of an "optical" ribbon 12*a* featuring on its underside a groove—on a "mechanical" ribbon 11*b* featuring on its upper side a male part designed to be inserted into the groove of the ribbon 12*b*. A reverse configuration whereby it's the "optical" ribbon 12*c* that features a male part that is inserted into the groove of the upper side of the "mechanical" ribbon 11*c* may also be provided. It should be noted that the "optical" and "mechanical" ribbons might be indifferently placed below or above one another, as it is expected for a timepiece to function properly in any spatial configuration.

With this hybrid hairspring concept, we can therefore defeat the inherent limits of the optical fibers or ribbons in terms of mechanical performance by combining them to hairsprings made with alloy-based materials, thus overcoming the mechanical deficiencies of the optical fibers or ribbons. Therefore, it is a matter of combining materials of significantly different Young's modulus: steel hairsprings: 220 GPa, silica SiO2: 107 GPa, glass: 67 GPa.

During the manufacturing stage of the elongated and malleable elements, it is also possible to provide a preforming designed to procure to the optical ribbons all kinds of section forms, for example a form with concave lateral faces 110.

We will now describe in greater detail, in reference to FIGS. 12 to 17, specific implementation methods of the manufacturing process according to the invention, wherein the hairspring is obtained by coiling it around a conformation tool of significant frustoconical shape. It should be noted that the shape of this tool is directly inspired by the fusees used in watchmaking. The conformation tool may be made for example in a ceramic material, in Nickel Alloy B, 800, 825, or even in Hastelloy C22 which has a melting temperature of 1399° C., which may allow the conformation tool to be integrated inside a furnace.

In reference to FIG. 12, the manufacturing system 12 includes a fiber drawing tower 120—which may typically be in the tens of centimeters in terms of dimensions, quite different from the fiber drawing towers used to produce optical fibers for telecommunications—intended to produce a fiber 121, which is vertically fed on a conformation device 122 featuring a mobile tool in rotation about a vertical axis and having a frustoconical spiral configuration. The fiber 121 is pulled from the fiber drawing tower 120 by a drawing device (not shown) and guided to be coiled around the conformation tool and produce a three-dimensional spiral form 10. In reference to FIG. 13, the manufacturing system may also be configured in order for the conformation tool to have a horizontal coiling axis.

It should be noted that the fiber drawing tower may feature a rectangular preforming hole at the output in order to produce at this stage of manufacturing a ribbon 14 of optical malleable material.

The ribbon conformed after coiling 15 is then separated from the conformation tool and still malleable, in reference to FIG. 15 and is then subjected, in reference to FIGS. 16 and 17, to a gradual vertical pressure by a pressure mechanism (not shown) to result in a hairspring of the appropriate shape to be integrated in a timepiece movement. This hairspring is then subjected to a thermal treatment and coatings capable of yielding appropriate mechanical characteristics for the mechanical oscillating function and optical characteristics adapted to the desired control functions. These coatings may, for example, implement the epoxy resin, gold, or diamond.

In reference to FIG. 18, one may provide at the outlet of the fiber drawing tower a preforming mechanism of the exiting fiber, with for example a rotating plate 18 featuring circular preforming holes 18*a* of the fiber, which is then guided to the conformation tool. We can also consider a plate featuring several different preforms, for example a circular preform 18*a*, a triangular preform 18*b* and a rectangular preform 18*c*.

In reference to FIGS. 19 to 22, the manufacturing method according to the invention may implement other conformation tools inspired by mechanical tools, such as drills of significant frustoconical shape 19 or of significant helical shape 20, an endless screw 21 or inspired by a helical ramp 22. In any case, the optical ribbon or fiber is guided in order to dispose it as a spiral form before treatment.

To ensure the guidance of the optical ribbon or fiber exiting the furnace and the performing phase, one may also provide, in reference to FIGS. 23 and 24, a guiding mechanism 23 featuring a mobile equipment 23*a* turning on the inner periphery of the guiding mechanism and featuring a guide channel 23*b* designed to receive the ribbon or the fiber 23*c*. With a specific arrangement of the moving parts of this guiding mechanism, it is possible to make the ribbon or the fiber follow an adapted spiral trajectory 24.

Furthermore, a conformation device directly inspired from the barrel conventionally used in timepiece movements may be implemented during the conformation phase. This "conformer" barrel, which may be directly derived from a typical barrel, may be used to bend and constrain the optical fiber into a spiral form before the conformation phase which implements the techniques previously described.

The manufacturing method according to the invention can produce hairsprings with dual mechanical-optical function from numerous types of materials both mineral and organic, even hybrid which combine organic and mineral. For example, new material concepts recently disclosed might be used, such as the polymer-based plastic material that can be formed like glass when heated, invented by Ludwik Leibler's team at ESPCI, or BK7 used for its optical properties.

Of course, the present invention is not limited to the implementation examples described above and numerous variants may be considered. Therefore, the implemented materials are not limited to silica or to plastics that can be formed like glass. Furthermore, other conformation tools than those described above may be used.

The invention claimed is:

1. A method of manufacturing a hairspring of a timepiece movement, comprising:

producing a malleable elongated element under a fiber or ribbon form, from a first heated material capable of guiding light, conforming said malleable elongated element into a spiral form, and handling processing said spiral form thus created to obtain a hairspring for providing both a mechanical oscillating function in a balance wheel and a light guiding function arranged for in situ adjusting of a mechanical performance of said hairspring, wherein the conforming comprises coiling the malleable elongated element around a rotating mobile conformation tool, and receiving said malleable elongated element in a guiding channel within a guiding mechanism and guiding said received malleable elongated element via mobile equipment turning on an inner periphery of the guiding mechanism.

2. The method according to claim 1, wherein the producing also further includes preforming the malleable elongated element.

3. The method according to claim 1, wherein the producing further comprises adding to the first heated material a second material that features physical properties adapted to provide to the malleable elongated element mechanical performance features compatible with the mechanical oscillating function.

4. The method according to claim 1, wherein the handling processing comprises coating the spiral form.

* * * * *